United States Patent [19]

Erickson et al.

[11] 4,121,375

[45] Oct. 24, 1978

[54] WHISTLE-CAP DEVICE

[75] Inventors: Wallace A. Erickson; Dorothea C. Erickson, both of Chicago, Ill.

[73] Assignee: Wallace A. Erickson & Company, Chicago, Ill.

[21] Appl. No.: 654,218

[22] Filed: Feb. 2, 1976

[51] Int. Cl.[2] ..... A63H 5/00
[52] U.S. Cl. ..... 46/175 R; 46/179
[58] Field of Search ..... 46/175, 179; 220/315

[56] References Cited

U.S. PATENT DOCUMENTS

| | | | |
|---|---|---|---|
| 917,271 | 4/1909 | Elliott et al. | 46/179 |
| 2,490,368 | 12/1949 | Millstein | 46/175 |
| 3,142,130 | 7/1964 | Weitzell | 46/179 |

*Primary Examiner*—Louis G. Mancene
*Assistant Examiner*—Robert F. Cutting
*Attorney, Agent, or Firm*—Merriam, Marshall & Bicknell

[57] ABSTRACT

A whistle-cap device adapted for attachment to a container having a head and threaded section extending from said head. The device includes threads adapted to mate with the threaded section of the container and a whistle portion which is inoperative when the device is assembled on a container.

2 Claims, 3 Drawing Figures

WHISTLE-CAP DEVICE

This invention relates to a combination whistle-cap adapted for use with tubes of materials and more particularly to a whistle-cap for use with tubes of toothpaste.

It is often desired to find means of encouraging children to bursh their teeth on a regular basis. Unfortunately, in many instances the act of brushing one's teeth is not one which is particularly attractive to a child, inasmuch as the child does not appreciate the benefits which result from a regular brushing of the teeth. Accordingly, it is desirable to have some inducement which is associated with the act of cleaning one's teeth which will serve to attract a child to undertake cleaning his or her teeth.

With the view of achieving this inducement, the invention disclosed herein relates to a combination whistle-cap which is adapted to fit over a tube of toothpaste, however, when the cap is removed, the whistle can be operated by the child or other operator. The cap is adapted to be attached in a conventional manner to a tube or container of toothpaste and the whistle portion of the device is oriented relative to the cap so that it cannot be played while the cap is screwed on or fastened by suitable connection means to the container. Accordingly, a child can be encouraged to remove the cap from the container for a brushing operation with the realization that he can blow the whistle when he finishes brushing his teeth.

These and other features and advantages of the invention will become apparent to those having ordinary skill in the art with reference to the drawings, description and appended claims.

DETAILED DESCRIPTION OF THE DRAWINGS

Figure 1:
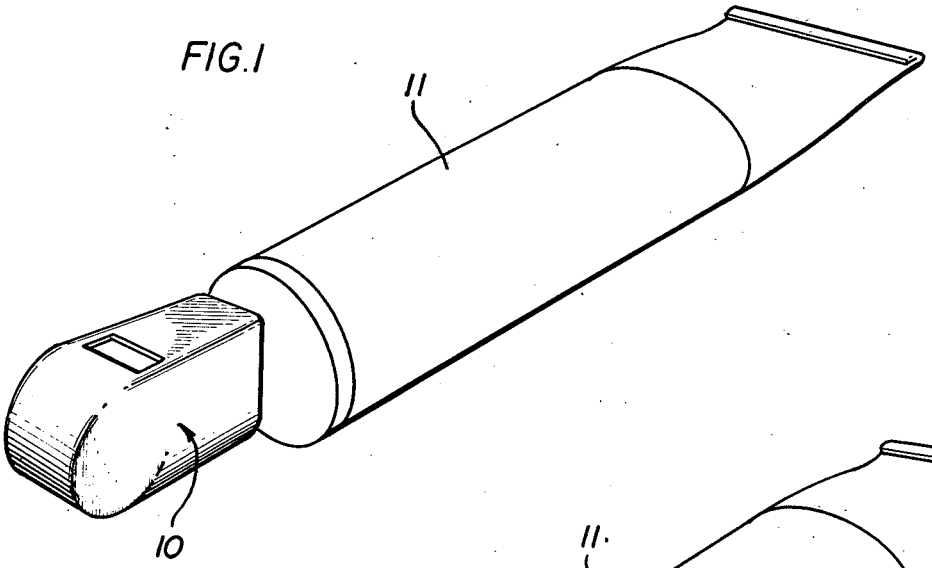
FIG. 1 shows the whistle-cap device of the present invention fastened to a tubular container.
Figure 2:
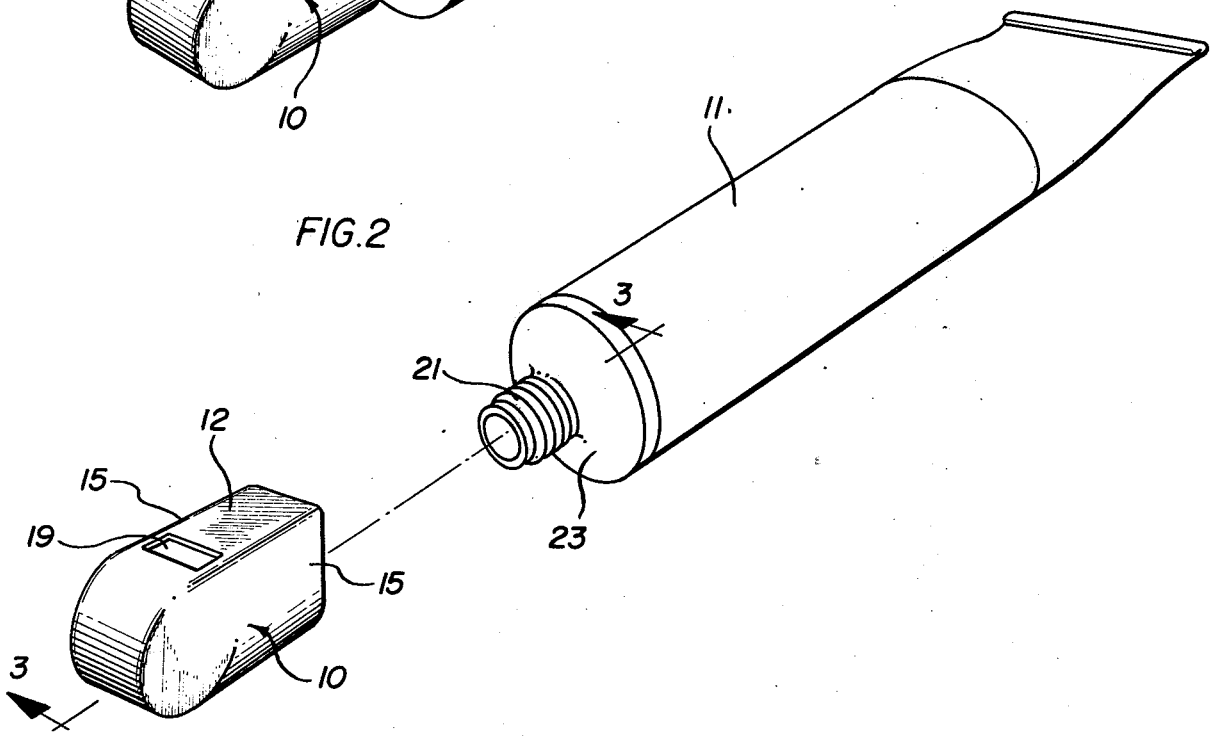
FIG. 2 shows the whistle-cap device of FIG. 1 removed from the container.

Referring to the drawings, there is shown a whistle-cap device 10 adapted to fit onto container 11, which can be a tubular type container such as the type often associated with toothpaste. Device 10 includes a body having a top wall 12, bottom 13, two sides 14, 15 and end 9.

The device includes a hollow space 16 located within the body and a passage 17 extending from space 16 to end 9. Passage 17 is located contiguous to top wall 12.

An opening 19 is located in top wall 12 and extends through wall 12 to passage 17.

Device 10 is recessed and threaded at 20 with the threads being adapted to fit over threads 21 extending out from head 23 of container 11. The threads 20 are located at the same end 9 of the device as the end of passage 17.

Figure 3:
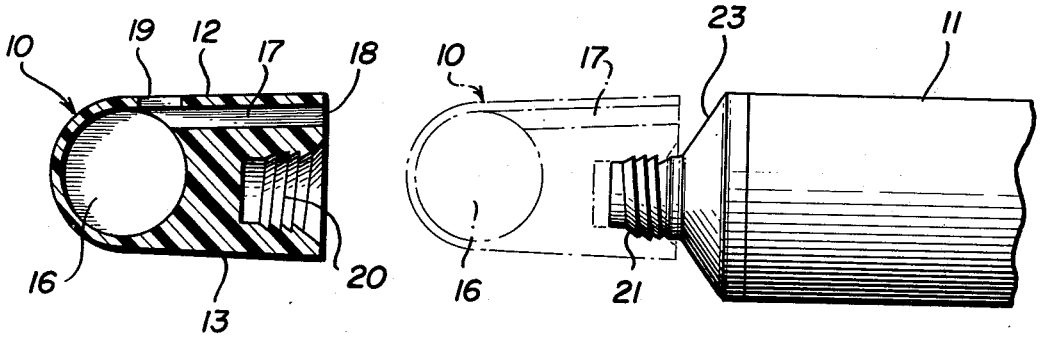
FIG. 3 shows a sectional side view of the whistle-cap device of the present invention taken along lines 3—3 in FIG. 2.

Referring to FIG. 3, the device is adapted to be threaded on the threaded section 21 of container 11 so that when device 10 is fastened to the container, the end 9 of the device is positioned contiguous to head 23 so that an individual cannot blow the whistle while the device is fastened to the container. When the cap is removed an individual can blow into the passage 17 and air will escape through opening 19 to provide a musical sound much like a whistle.

The device can be molded of one piece and made of any suitable plastic or other material.

The foregoing detailed description has been given for clearness of understanding only and no unnecessary limitations should be understood therefrom, as modifications will be obvious to those skilled in the art.

What is claimed is:

1. A whistle cap device and a container having a head with an opening therein to said container and fastening means associated with said head, said whistle-cap device comprising:

a body having a top wall, bottom and sides and an end;

said body having space located in said body;

means for permitting the operation of said whistle-cap device only when said device is unfastened from the container, said operating means including a hollow passage extending from said space to said end to form an opening in said device which extends from said end to said space, said passage being located contiguous to said top wall;

said top wall having an opening therein extending through said top wall to said passage; and, fastening means adapted to be fastened to said container, said fastening means being located adjacent said passage opening in said end;

said body fastening means being removably fastened to said container fastening means, whereby said device end will be positioned contiguous to said container head and said whistle-cap device will be inoperable as a whistle because of the inaccessibility of said passage opening but will be operable when said container is removed from said cap device.

2. The whistle-cap device and container of claim 1 wherein said body fastening means includes a threaded recess in said body and said container head is threaded whereby said container head is adapted to be removably threaded into said threaded body fastening means so that said container is positioned contiguous to said passage opening in said device end.

* * * * *